United States Patent [19]

Vanderkelen et al.

[11] 4,214,700

[45] Jul. 29, 1980

Best Available Copy

[54] METHOD AND APPARATUS FOR MAKING SNOW FOR SKI SLOPES AND THE LIKE

[75] Inventors: James B. Vanderkelen, Midland; William E. Riskey, Whitmore Lake, both of Mich.

[73] Assignee: Snow Machines, Inc., Midland, Mich.

[21] Appl. No.: 955,402

[22] Filed: Oct. 27, 1978

[51] Int. Cl.[2] ..... F25C 3/04

[52] U.S. Cl. ..... 239/2 S; 239/14; 239/132.5

[58] Field of Search ..... 261/124; 62/74, 121; 239/2 R, 2 S, 14, 132.5

[56] References Cited

U.S. PATENT DOCUMENTS

| | | | |
|---|---|---|---|
| 3,408,005 | 10/1968 | Struble et al. | 239/14 |
| 3,829,013 | 8/1974 | Ratnik | 239/14 |
| 3,923,246 | 12/1975 | Cloutier et al. | 239/2 S |
| 3,945,567 | 3/1976 | Rambach | 239/14 |
| 4,105,161 | 8/1978 | Kircher et al. | 62/74 X |

*Primary Examiner*—Andres Kashnikow
*Attorney, Agent, or Firm*—Barnes, Kisselle, Raisch & Choate

[57] ABSTRACT

Apparatus for and method of making snow which involves a water source, a compressed air source, a mixing chamber and an exit orifice. Compressed air and water are mixed in the chamber and then expelled into ambient air having a temperature below 32° F. A continuous flow of water substantially surrounds the mixing chamber and at least a portion of the exit orifice, and the amount and temperature of this flow of water is controlled to prevent clogging of the chamber and orifice by freezing of the water and air-water mixture therein. In one form the water is circulated past the mixing chamber and a major portion thereof is fed onwardly to additional snowmaking nozzles. The apparatus may comprise a miniature snowmaking gun operating as a seeder wherein the water and air are mixed to produce a seeding mixture, the seeder being disposed in a bulk water manifold of a fan-type snow machine and having an exit orifice nozzle protruding outwardly of the manifold to inject a seeding mixture into a unidirectional high volume air movement to form seed crystals. The seeder has a water inlet disposed within the manifold and communicating with the water being supplied therethrough to the said bulk water snow making nozzles of the machine. Valves in the compressed air and pressure water lines are also disposed in the bulk water flow.

9 Claims, 5 Drawing Figures

METHOD AND APPARATUS FOR MAKING SNOW FOR SKI SLOPES AND THE LIKE

The present invention relates to a method and apparatus for making snow for ski slopes and the like, and more particularly to an anti-freeze-up system for use in conjunction with snowmaking guns, whether of the relatively large type employed in making bulk snow or miniature snow guns used for generating seeding crystals in conjunction with fan-type or "airless" snow machines.

BACKGROUND OF THE INVENTION

In the past number of years there has been a continuaously increasing surge of interest in winter sports activities, particularly those activities which need a snow base for operation, e.g., skiing, snowmobiling, snowshoeing and the like. Unfortunately, in many areas of the world the natural snow fall is not predictable nor sufficient to assure continuous operation during the season of sports areas and resorts having facilities for such winter sports.

In more recent years continuity of operation and a good snow base have been gained by the use of artificial snow-making machines and apparatus. With such equipment snow-based winter sports activities have been continuously operated during the winter season and extended to geographical areas of the United States as far south, for example, as North Carolina, Virginia and Tennessee even though there is usually not sufficient natural snow in these areas to permit such sports on a regular basis during the season.

With artificial snow making equipment it is essential only that there be an ambient temperature below about 32° F. (0° C.) for a period sufficient to permit snow making to continue until an adequate depth of snow is deposited on the area, terrain or slope desired to be covered. In areas of North Carolina and Tennessee, for example, during a typical winter sports season there may be only 25 days with good conditions for making artificial snow. Farther north in Ohio 30 to 40 days for snow making operations ordinarily can be expected and in Michigan 50 days or more are not uncommon. Therefore, it is important for effective operation that large volumes of snow be made rapidly during those periods when conditions are right for mechanical snow making.

The snow making methods, apparatus and machines which have gained widespread commercial acceptance fall into two types, those which use compressed air in greater or lesser amounts and those which use no compressed air. This invention relates to those snowmaking methods, apparatus and machines that utilize compressed air.

Illustrative of one category of such methods and apparatus utilizing compressed air in a so-called "snow making gun" is that disclosed by Pierce in U.S. Pat. No. 2,676,471. This machine mixes compressed air with water within a spray nozzle to effect particle formation of the water along with a cooling of the water which results from the adiabatic expansion of the compressed air. In commercial practice it has been found that the Pierce machine and its successors are highly susceptible to nozzle freezing. The aforementioned Pierce U.S. Pat. No. 2,676,471 illustrates an early, if not the earliest, embodiments of a typical compressed air snowmaking gun. A more recent version of such a snow gun is that disclosed in Ratnik U.S. Pat. No. 3,829,013.

Another category of methods and apparatus for making and disposing snow uses compressed air but in much smaller quantities due to provision of a large fan or blower as described in Hanson U.S. Pat. No. 2,968,164, Jakob et al U.S. Pat. No. 3,596,476, Eustis et al U.S. Pat. No. 3,703,991, Rice U.S. Pat. No. 3,838,815 and Kircher U.S. Pat. No. 3,979,061. The most recent and improved form of such fan-type snow machines is that covered in the Kircher et al U.S. Pat. No. 4,105,161 which discloses, inter alia, a fan, an air-water seeder gun and bulk water manifold. While this Kircher et al method and machine is very energy efficient and capable of improved performance even under adverse temperature and humidity conditions, the relatively low water flow going through the "miniature" air-water snow gun utilized as a seeder in said apparatus has been found to cause seeder freeze-up problems in some applications.

One prior art attempt to prevent freeze-up in a fan-type snowmaking machine is that disclosed in the Rambach U.S. Pat. No. 3,945,567, which is assigned to the assignee hereof. In the Rambach patent pressurized water is circulated in a first manifold past a plurality of bulk water spray nozzles which extend in part through the water manifold and then the bulk water is fed to a second manifold with which the bulk water spray nozzles communicate. The water circulating in the first manifold maintains the temperature of such nozzles at a level above freezing so as to prevent clogging thereof by formation of ice therein. The snow machine of the Rambach patent also has a seeder snow gun 21 disposed interiorly of the fan cowling 20, and water is delivered to the mixing chamber of the seeder by a tap off connection to the main water manifold so as to circulate through a chamber 35 disposed forwardly and spaced from the mixing chamber 41 and exit orifice 43 of the seeder gun. Chamber 35 surrounding the forward end of the seeder forms a water jacket around the barrel to maintain the discharge orifice 30 thereon at a sufficiently high level to prevent any ice formation thereof.

However, in accordance with the present invention, it has been found that the main freeze up or clogging problem in compressed air-water snow guns, whether of the bulk snowmaking type or miniature seeding type, occurs primarily in the mixing chamber itself as well as close to the exit orifice leading directly from the mixing chamber, and in some cases in the air and water lines in the portions thereof in close proximity to the mixing chamber.

The purpose of this invention is to avoid such freeze-up problems in compressed air-water snow making guns whether used alone or as seeders in fan-type snow machines. Such freeze-up problems are avoided by employing apparatus and a method of making snow wherein compressed air and pressurized water are first mixed in some form of nozzle constituting a snow gun or seeder and the resulting mixture expelled into ambient air having a temperature below 32° F. The present invention thus involves an environment of a pressurized water source, a compressed air source, a mixing chamber and an exit orifice, and embodies the improvement of providing a continuous flow of water substantially surrounding said mixing chamber and at least a portion of said exit orifice in an amount and at a temperature sufficient to prevent clogging due to freezing of said water and said mixture prior to discharge thereof from said exit orifice.

It is believed that the basic theory of the present invention is, in a sense, exemplified by Lake Michigan.

Even in the coldest of winters Lake Michigan does not freeze solid because of the large mass of water involved. The present invention flows or maintains a relatively large mass of water around those portions of the air-water gun more likely to freeze. This large mass of water has been designated herein as the reservoir and acts as an anti-freeze-up heat source in somewhat the same manner as Lake Michigan does, and thus eliminates the need for any auxiliary source of heat or anti-freeze chemicals such as have been employed in the past to overcome this problem.

Accordingly, the aforementioned terminology "surrounding at least a portion of the exit orifice" is intended to mean that the typical nozzle which is used in air-water snow guns has, when embodying the present invention, at least the base thereof surrounded by said reservoir. Moreover, although there are many exit orifice designs known in the patent literature as well as in commercial usages, it is a feature of this invention that the reservoir extend to within at least one inch (25.4 mm) of that area where the air-water mixture is expelled to ambient air at ambient pressure. Any snow making gun at rest has an exit orifice which is exposed to ambient air and located at least functionally between the mixing chamber and the outside air. In most practical applications of the invention it has been found that this point in space defines the one inch limit for the reservoir to surround a portion of the exit orifice. In other words, it is contemplated that, consistent with practical design and engineering constraints, enough of the reservoir structure surround the exit orifice as well as mixing chamber to preclude freeze-up of the nozzle or gun, such freeze-up being prevented or precluded by a heat transfer relationship from the reservoir to the structure of the mixing chamber and exit orifice.

Another feature of the present invention resides in the circulation of the water through the reservoir on its way to additional snowmaking bulk water nozzles, such that the flow rate of water through the reservoir is at least twice that of the flow rate of water into the mixing chamber of the snow gun per se, and preferably the flow rate of water circulating through the reservoir is many times that of the flow rate of the water into the mixing chamber, such as in the order of 7 to 1 up to 20 to 1 and even higher.

In accordance with another feature of the invention when applied to a snow gun of the aforementioned Pierce/Ratnik type used for making bulk snow, rather than for seeding in conjunction with a fan-type machine, all of the bulk water being fed to the snow gun is first circulated through the reservoir and then admitted to the mixing chamber of the snow gun.

In accordance with a further feature of the invention, the compressed air source is connected to the mixing chamber by a conduit which contains a back check valve which in turn is also disposed in the reservoir to prevent freeze-up. In addition, the pressurized water source is coupled to the mixing chamber via a conduit containing a pressure regulating valve which also is disposed within the reservoir to prevent freeze-up of the valve.

Additional objects as well as advantages and features of the invention will be best understood from the following description when read in conjunction with the accompanying drawings in which:

FIG. 1 is a front elevational view, in simplified form and with certain parts omitted, of a snow machine as disclosed in the aforementioned Kircher et al U.S. Pat. No. 4,105,161 and illustrating a portion of the reservoir structure of the invention associated with the bulk water manifold of the machine.

FIG. 2 is an exploded perspective view illustrating the compressed air-water seeding gun structure and associated reservoir in exploded relation.

FIG. 2A is an exploded perspective view illustrating the bulk water manifold of the snow machine illustrated in FIG. 1 with the structure of FIG. 2 removed therefrom and illustrating in phantom a prior art seeding gun of Kircher et al U.S. Pat. No. 4,105,161.

Figure 1:
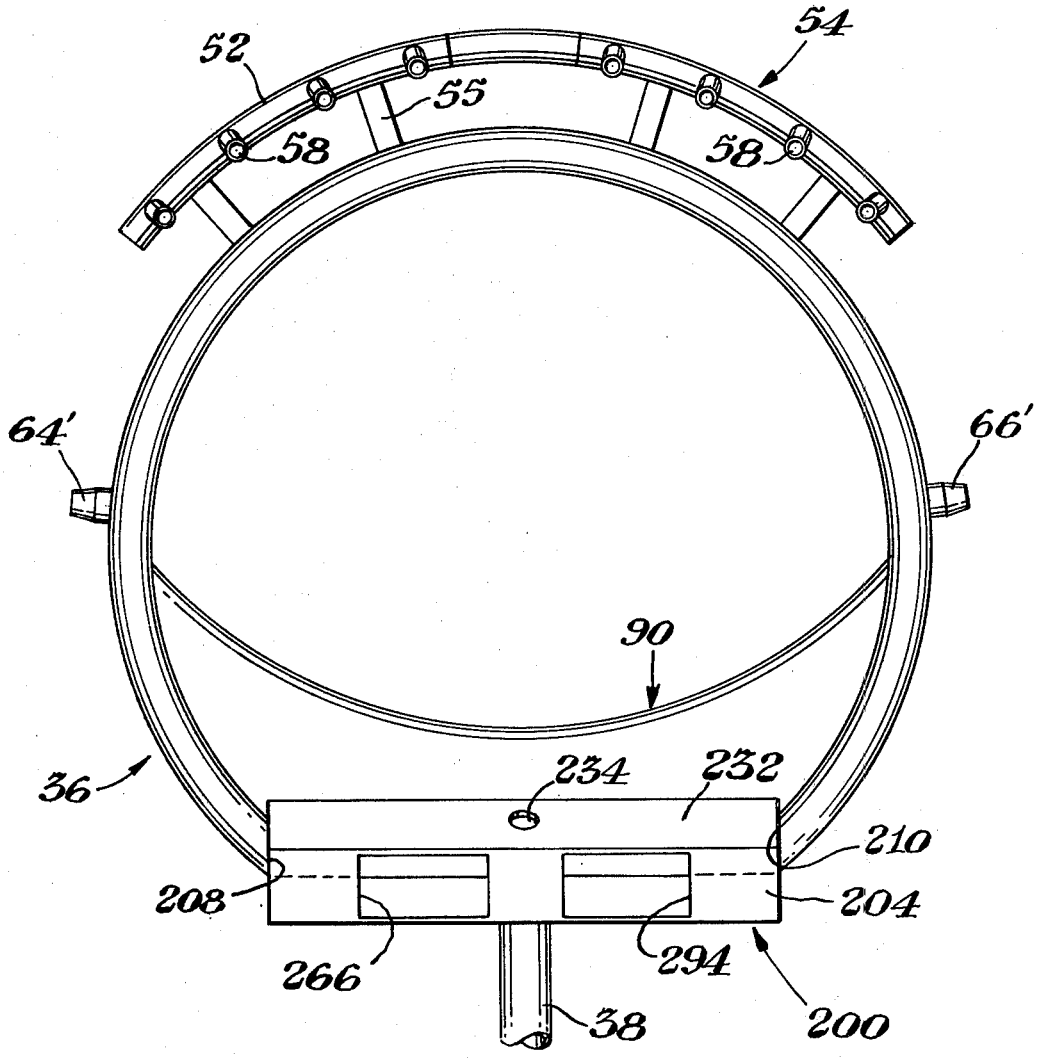

Referring in more detail to the drawings, FIG. 1 shows in front elevational view a fan-type snow machine as disclosed in the aforementioned Kircher et al U.S. Pat. No. 4,105,161, which is incorporated herein by reference and hence only a portion thereof is shown herein. Those structural elements which are shown in the Kircher et al patent are given the same reference numeral herein to facilitate correlation with the Kircher et al disclosure. Thus the snow machine has a main manifold 36 conducting bulk water to an arcuate array of water nozzles 42 (shown in a partial array). A pair of arcuate manifolds 52 and 54 are carried by supports 55 radially outwardly of manifold 36 and have a plurality of water spray nozzles 58 extending axially thereon. Water is fed to these secondary or upper manifolds 52 and 54 from the primary manifold 36 by a pair of couplings 64' and 66' connected by hoses 60 and 62 to manifold 52 and 54. Water flow to the upper manifolds 52 and 54 is controlled by water shutoff valve 64 (not shown) relative to manifold 52 and a corresponding valve 66 (not shown) associated with line 62 (not shown) leading to upper manifold 54. For a further understanding of the structure and operation of the environmental elements of the fan-type snow machine, reference may be made to the aforementioned Kircher et al patent.

In accordance with the present invention, the miniature seeder nozzle 70 (shown in phantom in FIG. 2A) of the aforementioned Kircher et al U.S. Pat. No. 4,105,161 is modified and disposed within a reservoir 200 in accordance with the present invention so as to provide a continuous flow of water in an amount and at a temperature sufficient to prevent freeze-up of the water and compressed air mixture within the seeder, as will be explained in more detail hereinafter.

Reservoir 200 comprises a hollow, rectangular four-sided box closed at its longitudinal ends by end panels 202 and 204. A lower segment 206 (shown in phantom in FIG. 2A) of manifold 36 is removed therefrom, leaving open spaced ends 208 and 210 positioned at approximately the 4:30 O'clock and 7:30 O'clock locations relative to manifold 36 (an arc of about 90°). This arc is spanned by reservoir 200 by welding ends 208 and 210 to panels 202 and 204 so as to communicate via openings 212 and 214 therein with the interior of reservoir 200. Preferably the reservoir extends horizontally between manifold ends 208 and 210 and is tipped forwardly and downwardly such that the height dimension of the reservoir is inclined at an angle of 30° relative to the plane of manifold 36. Fitting 38 is centrally welded to the bottom wall 216 of reservoir 200 so as to communicate via an opening in the bottom wall with the interior of the reservoir. Fitting 38 is disposed at a 30° angle relative to the height dimension of reservoir 200 so as to extend vertically downwardly therefrom and is adapted for coupling to a water hose fitting 218 to connect a bulk water hose to a source of water fed under pressure from a pump (not shown).

Figure 2:
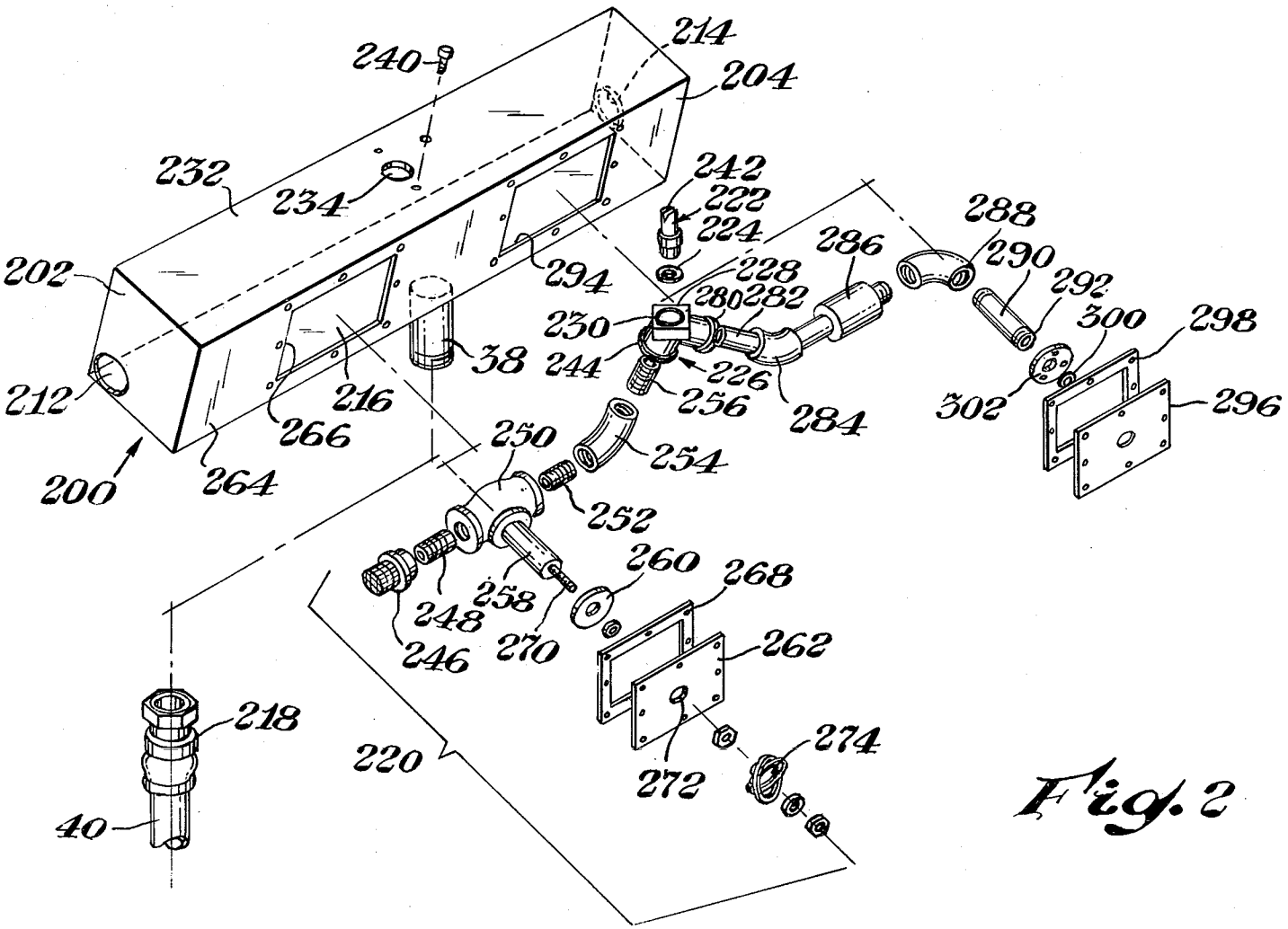
Figure 2A:
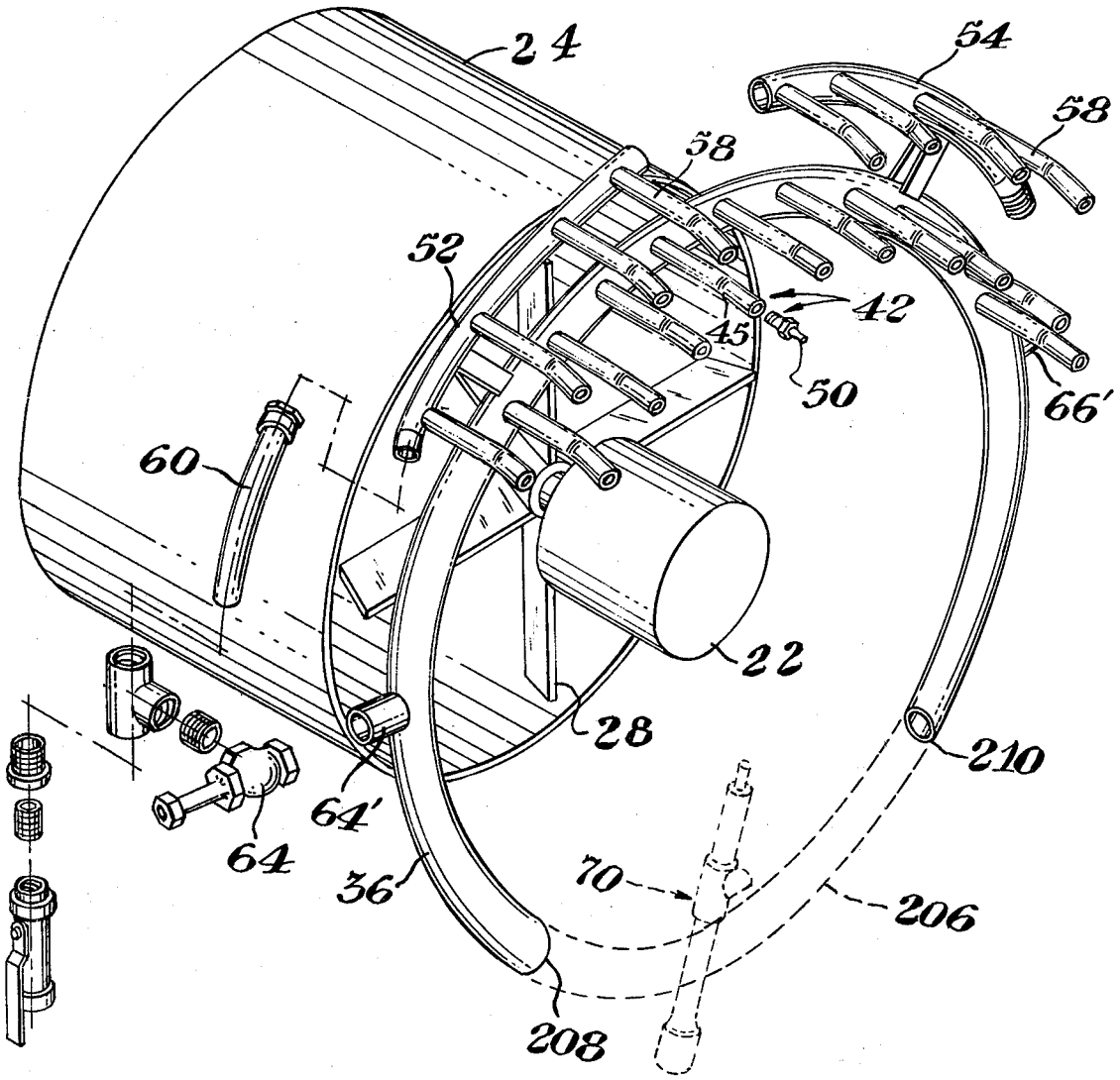

Reservoir 200 contains a miniature snowmaking seeder gun subassembly 220 disposed substantially entirely therewithin, this subassembly being shown in FIG. 2 in exploded perspective disassembled relationship exteriorly of the reservoir to facilitate understanding. Seeder 220 includes a dispensing nozzle 222, O-ring seal 224 and a pipe elbow 226 defining a mixing chamber therein. An apertured flange 228 is mounted to the center outside curvature of elbow 226 and communicates via a drilled hole with the interior of the elbow. Flange 228 carries a washer 230 which abuts the undersurface of top panel 232 of reservoir 200 in registry with a central opening 234 therein, flange 228 being fixed to panel 232 by a pair of studs 240. The central aperture of flange 228 is threaded to receive nozzle 222 such that O-ring 224 seats against the outer surface of panel 232 and sealably encircles nozzle 232. When so mounted, the nozzle 222 protrudes approximately 1" from panel 232, i.e., the slit-like exit orifice 242 of nozzle 222 communicates with the exterior ambient atmosphere at a location as close as feasible to the hollow interior of reservoir 200.

A supply of pressurized water is fed to the water inlet end 244 of elbow 226 from the interior of reservoir 200 via a water conduit made up of a filter fitting 246, male connector 248, adjustable gate valve 250, connector 252, elbow 254 and connector 256. The spindle sleeve 258 of valve 250 is threadably mounted by a collar 260 to a cover plate 262 which in turn is secured by screws to the front panel 264 of reservoir 200 so as to close an access opening 266 therein. Cover 262 is preferably sealed by a suitable gasket 268, and the spindle 270 of valve 250 projects through an opening 272 in cover 262 so as to mount an exterior control knob 274 and associated mounting parts and seals.

Compressed air is fed to the compressed air inlet 280 of elbow 226 from a suitable source of compressed air via a compressed air line made up of connector 282, elbow 284, male connector 286 containing a back check air valve, elbow 288 and conduit 290. The upstream end 292 of conduit 290 is threaded and protrudes through a companion access opening 294 in front panel 264 of reservoir 200 and through the associated access opening cover subassembly made up of cover 296, gasket 298, washer 300 and collar 302 fixed by screws to front panel 264. The protruding end 292 of the air line is thus adapted for connection to a suitable air hose which, in turn, is connected to a source of compressed air (not shown).

In operation, the various bulk water spray nozzles 42 and 58 are supplied with bulk water at a pressure normally ranging between 100 to 400 p.s.i. via hose 40, coupling 218 and fitting 38 such that the bulk water flow enters centrally of reservoir 200 and impinges directly against the exterior surface of elbow 226. The bulk water flow divides approximately equally in reservoir 200 and flows towards the opposite ends thereof and into the ends 208 and 210 of manifold 36 wherein it then circulates to the lower array of bulk spray nozzles 42 (i.e., pipes 45 and associated spray nozzles 50). The upper left and right banks of secondary spray nozzles 58 are selectively fed with bulk water from manifold 36 via the associated conduits 64',66', valves 64 and 66 and hose lines 60 and 62. Customarily, the bulk water flow rate may vary from 20 to 200 gallons per minute, depending upon the number of spray nozzles selected for operation according to ambient conditions.

Under most conditions, and particularly under adverse temperature and humidity conditions for snowmaking, seed crystals are introduced into the main air stream exiting from cowling 24 of the snow machine in a manner similar to that disclosed in the aforementioned Kircher et al U.S. Pat. No. 4,105,161 by operation of the miniature snowmaking seeder gun 220. To accomplish this action, compressed air is admitted via the compressed air line 280–292 to elbow 226 at a pressure normally ranging between 50 to 120 p.s.i. and at a flow rate ranging between 40 to 200 cubic feet per minute. Pressurized water is admitted to the water inlet 244 of elbow 226 via water line 246–256 from within reservoir 200 under the control of valve 250 which is suitably adjusted to provide a proper water to air ratio entering elbow 226. The pressurized streams of water and air intersect and co-mingle in the interior of elbow 226, the same thus functioning as the mixing chamber of the seeder gun. Mixture of compressed air and water in elbow 226 and expansion of such mixture upon exiting from the orifice 242 of the associated seeder nozzle 222 causes formation of seed crystals in a high velocity stream issuing upwardly and outwardly in an orientation similar to that shown issuing from seeder 70 in FIG. 1 of the aforementioned Kircher et al U.S. Pat. No. 4,105,161. The orientation of reservoir 200 relative to the cowling 24, nozzles 42 and 58 and/or deflector 90 of the Kircher et al patent machine results in the enhanced performance and snowmaking ability under adverse conditions provided by the invention in the Kircher et al patent.

In addition, the seeder gun 220 of the present invention is free of ice-clogging and freeze-up problems because there is a substantial engulfment of the seeder gun assembly within the bulk water reservoir 200. Thus, it will be noted that in operation of the snow machine with one or more of the bulk water spray nozzles turned on, there is a continuous flow of bulk water impinging upon and flowing past the external surfaces of the mixing chamber 226 as well as the air and water lines leading thereto via the interior of reservoir 200. It has been found the flow of bulk water in the aforementioned normal operating range of the snow machine, even when fed from a pump from an outdoor pond under the coldest ambient conditions, provides a flow of water in an amount and at a temperature sufficient to prevent a freezing clog-up despite seed ice crystals being formed by the pressurized water and compressed air mixture being formed in mixing chamber 226 and expelled from the seeder gun via exit orifice 242 to ambient atmosphere during operation of the snow machine. It will also be noted that the flow rate of input water to reservoir 200 is enhanced by the feature of drawing water to the seeder gun 220 from the interior reservoir 200, it being understood that the ratio of bulk water flow to the spray nozzles to the flow of water to the seeder gun normally ranges between 2 to 1 to 40 to 1.

Moreover, the disposition or the seeder water line 246–256 within the reservoir 200 has been found to eliminate the problem of freeze-up in the water line as well as in the water control valve 250. Similarly, the disposition of the compressed air seeder feed line 280–292 within reservoir 200 overcomes ice clogging freezing up problems hitherto encountered with an exterior feed. This also enables the use of the check valve 286 in the air line which is operable to prevent flow of water from mixing chamber 226 backwardly into the compressed air line without thereby encountering the problem of freeze-up of the check valve.

By using the normal source of pressurized water for the bulk water spray nozzles, the water temperature will normally be a temperature above 32° F. because water is customarily drawn from the denser (34° F. zone) of a water supply pond at most ski areas and because heat input from the water pump is usually sufficient to insure above-freezing water conditions in the distribution network leading to the various snow machine locations. Hence an adequate heat transfer relationship is maintained between the water inflow to reservoir 200 to overcome the rate of heat extraction occurring in the mixing chamber 226 due to adiabatic expansion of the compressed air therein to prevent clogging by water freezing-up in the seeder 220. Of course, it will be understood to one skilled in the art based upon the foregoing disclosure that the volumetric capacity of reservoir 200, the flow rate of water therethrough and the temperature of the water flowing therethrough should be properly correlated with the aforementioned rate of heat extraction of mixing chamber 226 so as to provide a heat transfer condition relative to mixing chamber 226 as well as nozzle 222 which is sufficient to prevent a freezing condition therein of a nature which would clog or otherwise render inoperable the mixing chamber and/or nozzle 222 and hence seeder gun 220. In one working embodiment of the invention, as illustrated in FIGS. 1 and 2 herein, this condition was obtained by limiting the protrusion of exit orifice 242 to within a distance of approximately 1" from the metal top panel 232 of reservoir 200.

Figure 4:
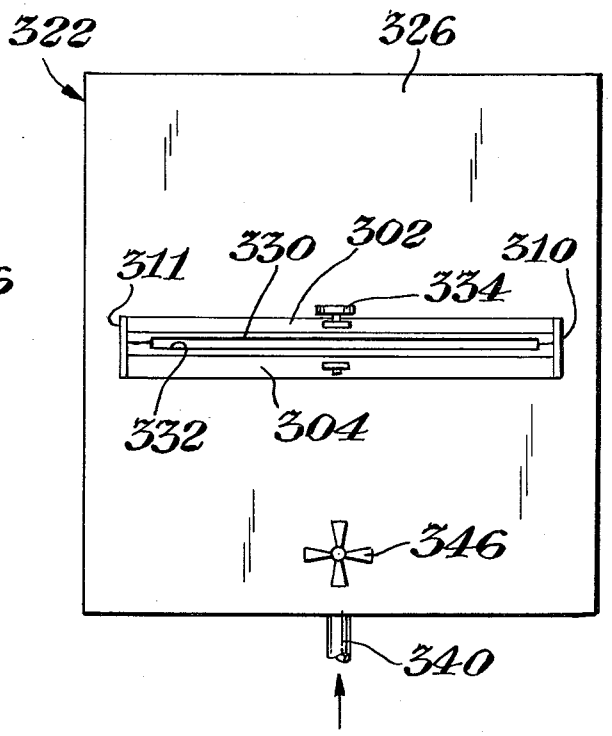
FIG. 4 is a front elevational view of the snow gun of FIG. 3.
Figure 3:
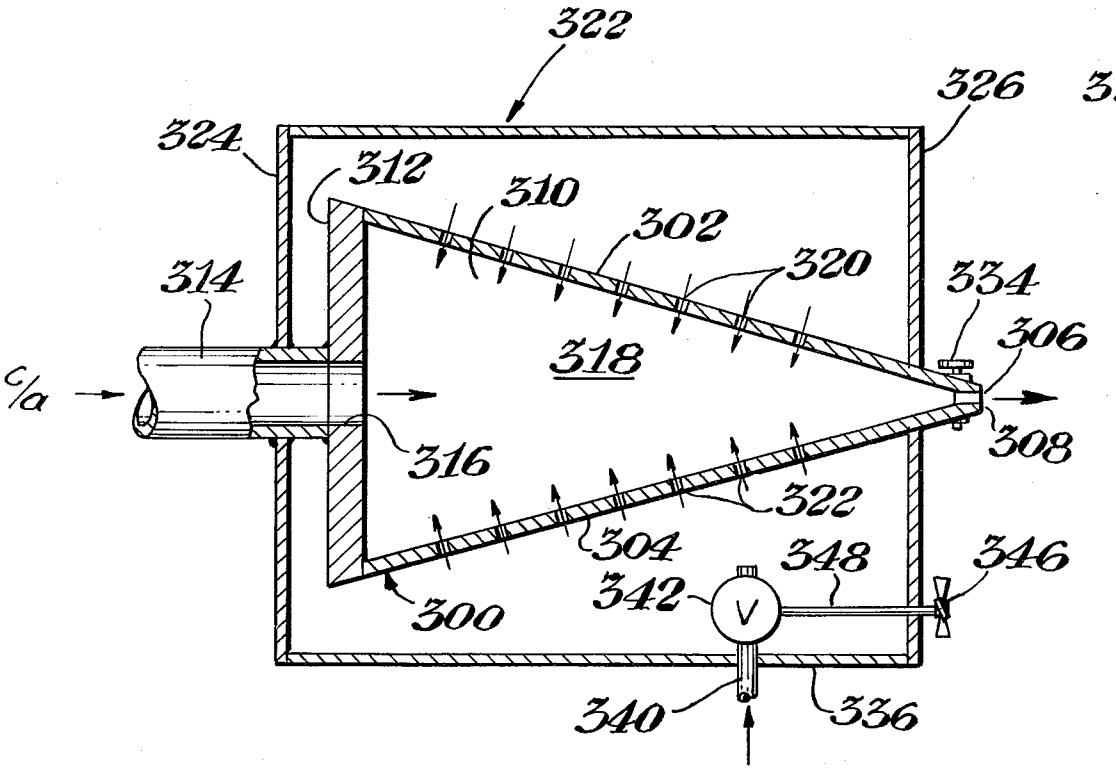
FIG. 3 is a side elevational view taken in center section illustrating in simplified schematic form a snow gun with a surrounding reservoir and embodying another aspect of the present invention.

Referring to FIGS. 3 and 4, another embodiment of the invention is illustrated wherein a snowmaking gun generally of the aforementioned Pierce or Ratnik-type is provided with the anti-freeze-up reservoir of the invention. More particularly, the invention is shown applied to a compressed air-water snowmaking gun 300 of the type shown in FIGS. 5 and 6 of Kircher U.S. Pat. No. 3,979,061, gun 300 being shown in simplified form to facilitate understanding. Gun 300 consists of top and bottom plates 302 and 304 which converge towards one another to meet at their forward end edges 306 and 308 respectively. Plates 302 and 304 are joined along their sides by side plates 310 and 311 welded in sealed relation thereto. The top, bottom and side plates 302, 304, 310 and 311 are secured and sealed at their rear edges to a back plate 312. A compressed air conduit 314 is welded or otherwise secured to back plate 312 and communicates via an opening 316 therein with the interior mixing chamber 318 of the gun. Top plate 302 and bottom plate 304 are each provided with an appropriate pattern of small orifices 320 and 322 respectively communicating the exterior of gun 300 with mixing chamber 318.

The entire gun 300 is enclosed within a rectangular six-sided box 322, the rear wall 324 of which has an opening through which conduit 314 projects in sealed relation therewith. A front wall 326 of the reservoir box 322 has an opening through which the pointed nose of gun 330 projects a very short distance, preferably on the order of the aforementioned 1" limit. Matching notches 330 and 332 are provided in the mutually facing forward edges of walls 302 and 304 to provide an exit orifice communicating the mixing chamber 318 with the exterior of the snow gun. The slot width of exit orifice 330–332 is adjustable by means of the threaded screw 334 in a manner similar to screw 55 in the aforementioned Kircher patent. The bottom wall 336 of reservoir 322 has a water conduit 340 extending therethrough in sealed relation to the interior of reservoir 322. A control valve or pressure regulating valve 342 is disposed in line 340 interiorly of reservoir 322 and controlled by an exterior knob 346 connected by a spindle 348 to valve 342. Preferably, although not shown, conduit 314 is also provided with a back check air valve disposed within the confines of reservoir 322.

In operation, snow gun 300 is fed with its entire bulk water supply via line 340 which supplies water to and completely fills the interior of reservoir 322 exteriorly of gun 300 with pressurized water. Conduit 340 is suitably sized to provide a flow rate of water into reservoir 322 greater than the capacity of the combined array of orifices 320 and 322 so that the snow gun 300 remains completely surrounded by the body of water flowing into the reservoir. The pressurized water in reservoir 322 is then admitted by orifices 320 and 322 to the mixing chamber 318 where it meets the high pressure air stream admitted by a conduit 314. This produces a mixture which issues from the exit orifice 330–332 in the form of a high velocity mixture of air and water droplets containing seed crystals which, upon striking ambient air at 32° or below, results in the water particles freezing into ice crystals and thereby producing man-made snow.

Preferably, gun 300 is put into operation by first turning on the air supply admitted via conduit 314 to fill chamber 318 with compressed air while the same issues from the exit orifice 330–322 of chamber 318. Then water valve 342 is gradually increasingly opened to admit water into reservoir 322 until a pressure buildup occurs such that when the water pressure exceeds the air pressure water will issue in jets via orifices 320 and 322 into chamber 318. Suitable adjustment of the ratio of the flow rates and pressures of the compressed air supply and water supply is made with adjustment nozzle 346. The air flow rate normally is a constant although a pressure regulator valve may be provided in conduit 314 to automatically regulate the pressure of the compressed air admitted to chamber 318.

As in the previous embodiment, the flow rate of water admitted to reservoir 322 is correlated in amount and temperature with the heat extraction occurring in mixing chamber 318 to calimetrically prevent a freeze-up of the compressed air-water mixture produced in chamber 318 of such a nature as would cause ice buildup and clogging of the snow gun. As can be seen in FIGS. 3 and 4, the snow gun 300 is engulfed substantially entirely by reservoir 322 except that the nozzle portion of the snow gun protrudes from end wall 326 of the reservoir only as far is as necessary to provide access to the adjustment screw 334 at the exterior of the reservoir. However, the close proximity of the exit orifice to the bulk water in reservoir 322 is sufficient to provide a heat transfer relationship to the walls of the snow gun of an order sufficient to prevent freeze-up clogging of the exit orifice of the snow gun.

We claim:

1. In a snowmaking process which includes an air-water snowmaking seeder gun in combination with means for generating a substantially unidirectional high-volume air stream at substantially atmospheric pressure into which bulk water is directed from an array of bulk water nozzles, said air-water snowmaking gun including a water source, a compressed air source, a mixing chamber and an exit orifice, the improvement which comprises the steps of:

(1) passing a pressurized flow of incoming water in a manner to surround substantially all of said mixing chamber and at least a portion of said exit orifice, (2) supplying water to said gun by admitting a minor portion of said flow of incoming water to said gun, and (3) thereafter flowing at least a major portion of said incoming water to said bulk water nozzles.

2. In an apparatus for making snow which includes means for providing a substantially unidirectional high-volume air stream at substantially atmospheric pressure, a water manifold having a plurality of nozzles disposed to direct water spray into said air stream, and seeder means mixing a stream of high velocity water with a stream of high velocity air to produce a seeding mixture, said seeder means being disposed in said water manifold and having an exit orifice nozzle protruding outwardly of said manifold to inject said seeding mixture into said unidirectional air movement to form seed crystals.

3. The apparatus set forth in claim 2 wherein said seeder means has a water inlet disposed within said manifold and communicating with the water being supplied therethrough to said nozzles.

4. The apparatus set forth in claim 3 wherein said seeder means includes a compressed air line communicating with a mixing chamber of said seeder means and having a portion extending at least in part through said manifold, said portion of said compressed air line containing a check valve operable to prevent flow of water backwardly into said compressed air line.

5. The apparatus set forth in claims 3 or 4 wherein said water inlet for said seeder means includes a water flow regulating valve disposed within said manifold.

6. Apparatus for making snow in flake or seed form comprising a mixing chamber, a source of compressed air, a source of pressurized water adapted to provide water at a temperature above 32° F., first conduit means for communicating said source of compressed air with said mixing chamber, second conduit means for communicating said pressure water source with said mixing chamber, and reservoir means adapted to contain a body of water and substantially enclosing at least said mixing chamber to engulf the same with said body of water and means for providing a flow of water via said second conduit means through said reservoir means at a temperature above 32° F., said mixing chamber having an exit orifice for releasing the mixture of compressed air and water formed in said mixing chamber exteriorly of said mixing chamber, said exit orifice protruding from said reservoir means in close proximity and in heat transfer relation thereto, the volumetric capacity of said reservoir means and the flow rate and temperature of the water flowing through said reservoir means being correlated with the rate of heat extraction from said mixing chamber and exit orifice so as to provide a heat transfer condition relative to said mixing chamber effective to prevent a freezing condition therein of a nature which would clog or otherwise render inoperable said mixing chamber, said first conduit means including a check valve operable to prevent backflow of water therein, said check valve being disposed in said reservoir means.

7. The apparatus set forth in claim 6 wherein said second conduit means includes flow regulating means disposed at least partially in said reservoir means.

8. The apparatus set forth in claim 6 wherein said mixing chamber has a plurality of water ports extending through a wall of said mixing chamber, said ports communicating said reservoir means with said mixing chamber and adapted to provide a series of water jets issuing into said mixing chamber oriented to impinge against compressed air admitted to said mixing chamber via said first conduit means such that the resultant mixture exits from the mixing chamber via said exit orifice and is converted to snow in flake or seed form in ambient air having a temperature at or below 32° F.

9. The apparatus set forth in claims 6 or 7 wherein said reservoir means comprises a water manifold having a plurality of nozzles disposed to direct water supply into a substantially unidirectional high volume air stream at substantially atmospheric pressure.

* * * * *